US011042112B2

(12) United States Patent
Kaseda

(10) Patent No.: US 11,042,112 B2
(45) Date of Patent: Jun. 22, 2021

(54) IMAGE FORMATION APPARATUS

(71) Applicant: Oki Data Corporation, Tokyo (JP)

(72) Inventor: Shinya Kaseda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 123 days.

(21) Appl. No.: 16/413,600

(22) Filed: May 16, 2019

(65) Prior Publication Data

US 2020/0004190 A1 Jan. 2, 2020

(30) Foreign Application Priority Data

Jun. 28, 2018 (JP) ..... JP2018-122934

(51) Int. Cl.
*G03G 15/00* (2006.01)

(52) U.S. Cl.
CPC ..... *G03G 15/6523* (2013.01)

(58) Field of Classification Search
CPC ..... G03G 15/6523; G03G 2215/00814; B65H 2301/44334
See application file for complete search history.

(56) References Cited

U.S. PATENT DOCUMENTS 5,049,123 A * 9/1991 Breton ..... B41F 13/54 493/416
8,781,386 B2 * 7/2014 Shimizu ..... G03G 15/6558 399/388
2007/0007708 A1 * 1/2007 Nishimura ..... B65H 37/00 271/109
2017/0315479 A1 * 11/2017 Sato ..... G03G 15/1695
2018/0217550 A1 * 8/2018 Akiyama ..... G03G 15/6523

FOREIGN PATENT DOCUMENTS

JP 2006-030333 A 2/2016

OTHER PUBLICATIONS

"File:Tribo.png" as downloaded by the Internet Archive on Oct. 2, 2015; http://soft-matter.seas.harvard.edu/index.php/File:Tribo.png (Year: 2015).*

* cited by examiner

*Primary Examiner* — Justin N Olamit
(74) *Attorney, Agent, or Firm* — Metrolex IP Law Group, PLLC

(57) ABSTRACT

An image formation apparatus according to an embodiment may include: a cutting unit including a cutting member, a polarity of the cutting member being opposite to a polarity of the medium in a triboelectric series; an image formation unit that forms an image on the medium cut by the cutting unit; and a pressure contact unit arranged between the cutting unit and the image formation unit, and including a first pressure contact member and a second pressure contact member that are put in pressure contact with each other across the medium cut by the cutting unit, a polarity of the first pressure contact member being opposite to the polarity of the medium in a triboelectric series, a polarity value of the second pressure contact member shifted from a polarity value of the first pressure contact member toward the polarity of the medium in the triboelectric series.

12 Claims, 9 Drawing Sheets

IMAGE FORMATION APPARATUS

CROSS REFERENCE TO RELATED APPLICATIONS

This application claims priority based on 35 USC 119 from prior Japanese Patent Application No. JP2018-122934 filed on Jun. 28, 2018, entitled "IMAGE FORMATION APPARATUS", the entire contents of which are incorporated herein by reference.

BACKGROUND

The disclosure relates to an image formation apparatus which cuts a medium and forms an image on the cut medium.

An electrophotographic image formation apparatus is widely in use as an image formation apparatus which forms an image on a medium. This is because the electrophotographic image formation apparatus is capable of obtaining a sharper image in a shorter time than other types of image formation apparatuses, including an inkjet image formation apparatus.

Some proposals have been made for the configuration of the electrophotographic image formation apparatus. Specifically, for the purpose of preventing paper powder from causing image defect, a polarity value of a surface material of a sheet-backside roller is set to be on a negative side of a polarity value of a surface material of a sheet-front-side roller (for example, Patent Literature 1).

Patent Literature 1: Japanese Patent Application Publication No. 2006-030333

SUMMARY

Although various proposals have been made to improve the performance of the image formation apparatus for image formation, the performance of the image formation apparatus may be still insufficient, and has room for improvement.

An object of an aspect of one or more embodiments of the disclosure may be to provide an image formation apparatus capable of forming an image on a medium stably.

An image formation apparatus according to an aspect of one or more embodiments may include: a cutting unit including a cutting member that cuts a medium, a polarity of the cutting member being opposite to a polarity of the medium in a triboelectric series; an image formation unit that forms an image on the medium cut by the cutting unit; and a pressure contact unit arranged between the cutting unit and the image formation unit, and including a first pressure contact member and a second pressure contact member that are put in pressure contact with each other across the medium cut by the cutting unit, a polarity of the first pressure contact member being opposite to the polarity of the medium in a triboelectric series, a polarity value of the second pressure contact member shifted from a polarity value of the first pressure contact member toward the polarity of the medium in the triboelectric series.

The aspect may make it possible to form an image on a medium stably.

DETAILED DESCRIPTION

Figure 1:
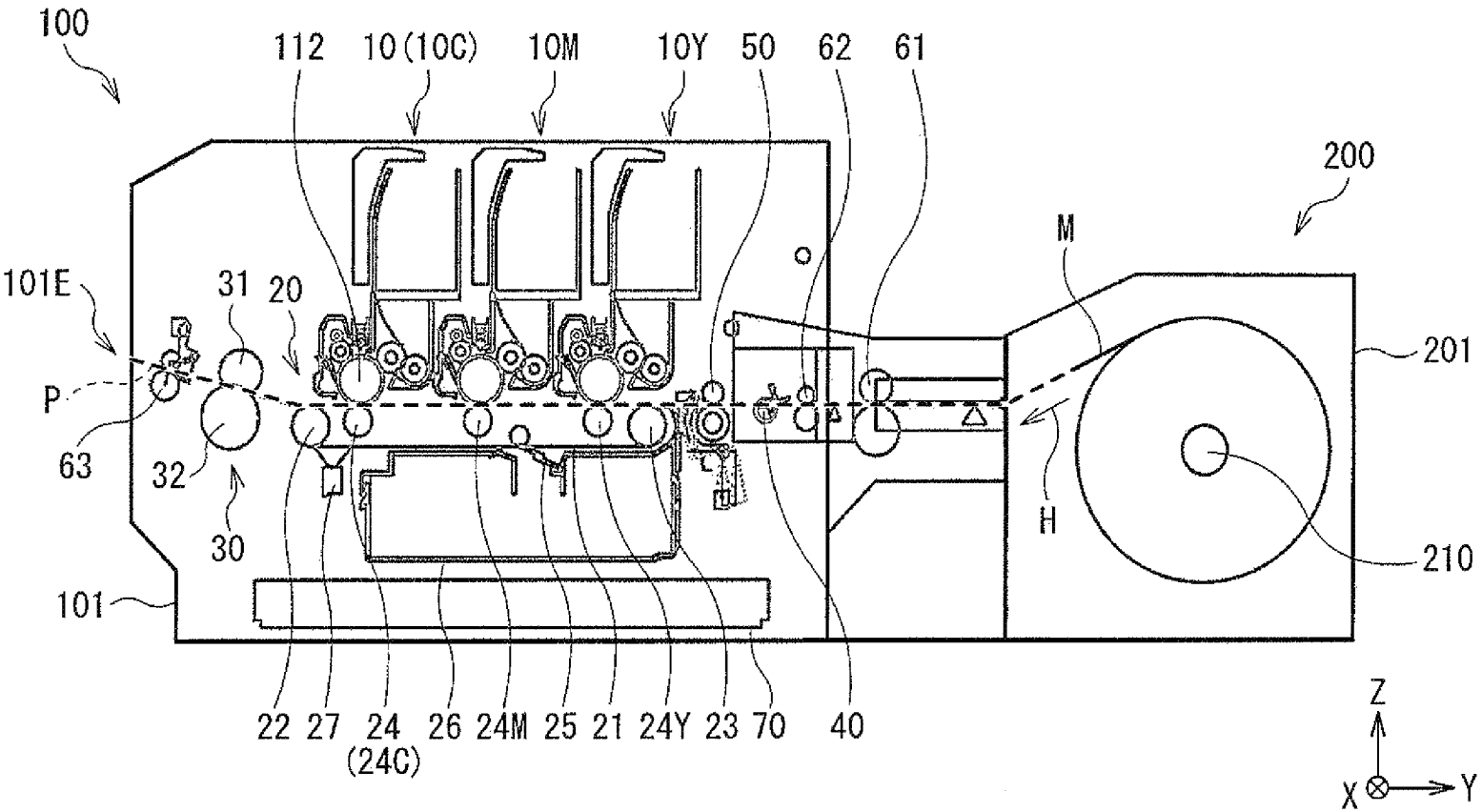
FIG. 1 is a diagram illustrating a plan view of a configuration of an image formation apparatus according to one or more embodiments.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Descriptions are provided for an image formation apparatus according to one or more embodiments in the following order.

1. Image Formation Apparatus
1-1. Overall Configuration
1-2. Configuration of Development Units
1-3. Configuration of Cutting Unit
1-4. Configuration of Collection Unit
1-5. Polarities of Main Constituents
1-6. Working
1-7. Operation and Effects
2. Modifications <1. Image Formation Apparatus>

The image formation apparatus herein described is an apparatus which forms an image on a medium M (see FIG. 1) using toner T (see FIG. 2) as described later, and is, for example, a so-called electrophotographic full-color printer.

This image formation apparatus, for example, unwinds the medium M from its roll, cuts the medium M while conveying the medium M, and thereafter forms an image on the cut medium M. Types of medium M are not specifically limited, and may be, for example, one or more of paper, film and the like.

<1-1. Overall Configuration>

FIG. 1 is a diagram illustrating a plan view of a configuration of the image formation apparatus. As illustrated in FIG. 1, the image formation apparatus includes, for example, a processing unit 100 and a supplying unit 200. The supplying unit 200 is connected to the processing unit 100, for example, in order that that the supplying unit 200 is capable of supplying the medium M to the processing unit 100.

[Processing Unit]

The processing unit 100 performs a process of: cutting the medium M supplied from the supplying unit 200; and forming an image on the cut medium M. The processing unit 100 includes, for example, development units 10, a transfer unit 20, a fixation unit 30, a cutting unit 40, a collection unit 50, conveyance rollers 61 to 63, and a control board 70 inside an openable/closable housing 101. The development units 10, the transfer unit 20 and the fixation unit 30 form the image on the medium M cut by the cutting unit 40. In this respect, the development units 10, the transfer unit 20 and the fixation unit 30 may be referred to as an "image formation unit" according to an aspect of one or more embodiments of the disclosure. The collection unit 50 may be referred to as a "pressure contact unit" according to an aspect of one or more embodiments of the disclosure.

The housing 101 is provided, for example, with a discharge port 101E through which the medium M with the image formed thereon is discharged. The medium M supplied from the supplying unit 200 to the processing unit 100 is conveyed along a conveyance passage P in a conveyance direction H. FIG. 1 and the subsequent drawings illustrate the conveyance passage P with a dashed line.

(Development Units)

The development units 10 each perform an adhesion process (development process) on an electrostatic latent image using the toner T. Specifically, the development units 10, for example, each form the electrostatic latent image, and each make the toner T adhere to the electrostatic latent image using a Coulomb force.

The number of development units 10 is not specifically limited. In this configuration, the processing unit 100 includes, for example, three development units 10 (10Y, 10M, 10C). The development units 10Y, 10M, 10C, for example, are detachably attached to the housing 101, and are arranged from an upstream side to a downstream side in the conveyance direction H in this order.

The development units 10Y, 10M, 10C have the same configuration, for example, except that colors of the toners T contained in their respective toner containers 12 are different from each other. A detailed configuration of the development units 10 (10Y, 10M, 10C) is described later (see FIG. 2).

(Transfer Unit)

The transfer unit 20 performs a transfer process of the toners T which are developed by the respective development units 10. Specifically, the transfer unit 20 transfers the toners T, which is attached to the electrostatic latent images by the development units 10, onto the medium M cut by the cutting unit 40.

The transfer unit 20 includes, for example, a conveyance belt 21, a driving roller 22, a driven roller 23, transfer rollers 24, a cleaning blade 25, a collection box 26 and a sensor 27.

The conveyance belt 21 is a member which moves the medium M, cut by the cutting unit 40, in the conveyance direction H, and may be, for example, an endless belt. The conveyance belt 21 is stretched, for example, between the driving roller 22 and the driven roller 23, and moves in response to the rotation of the driving roller 22. The driving roller 22 rotates using power of a motor or the like, while the driven roller 23 rotates in response to the rotation of the driving roller 22.

Each transfer roller 24 is put in pressure contact with the corresponding development unit 10 (photosensitive drum 112, see FIG. 2) with the conveyance belt 21 in between, and transfers the toner T, which is attached to the electrostatic latent image, onto the medium M. The number of transfer rollers 24 is not specifically limited, but is as many as the number of development units 10. In this configuration, since the number of development units 10 is three (10Y, 10M, 10C), the number of transfer rollers 24 is three (24Y, 24M, 24C) as well.

The cleaning blade 25 is put in pressure contact with the conveyance belt 21, and scrapes away foreign matter, such as toners T remaining on the surface of the conveyance belt 21. The collection box 26 collects the foreign matter which the cleaning blade 25 scrapes away.

The sensor 27 detects the toners T which the transfer rollers 24 transfer onto the medium M. The sensor 27 is arranged, for example, downstream of the development units 10 in a movement direction of the conveyance belt 21. Specifically, the sensor 27 is arranged a position upstream of a position where the transfer of the toners T starts, but downstream of a position where the transfer of the toners T ends. Furthermore, the sensor 27 includes, for example, a photosensor which detects the presence or absence of the toners T using light reflection.

(Fixation Unit)

The fixation unit 30 performs a fusing process or a fixing process of the toners T which are transferred to the medium M by the transfer unit 20. Specifically, the fixation unit 30 fix the toners T on the medium M, for example, by heating the medium M to which the toners T are transferred by the transfer unit 20 while pressurizing the toners T onto the medium M.

The fixation unit 30 is arranged downstream of the development units 10 and the transfer unit 20 in the conveyance direction H, and includes, for example, a heating roller 31 and a pressure roller 32. The heating roller 31 heats the toners T which the transfer rollers 24 transfer onto the medium M. The pressure roller 32 is put in pressure contact with the heating roller 31, and pressurizes the toners T which the transfer rollers 24 transfer onto the medium M.

(Cutting Unit)

The cutting unit 40 performs a process (a cutting process) of cutting the medium M supplied from the roll by the supplying unit 200. Specifically, the cutting unit 40 includes, for example, a rotary cutter, and cuts a predetermined dimension (length) of medium M while conveying the medium M. The cutting unit 40 is arranged upstream of the collection unit 50 in the conveyance direction H.

Descriptions are provided later for a detailed configuration of the cutting unit 40 (see FIGS. 3 to 5).

(Collection Unit)

The collection unit 50 performs a process (collection process) of collecting cut matter D (see FIGS. 12 to 14) which occurs due to the cutting of the medium M by the cutting unit 40. The cut matter D may be unwanted matter which occurs when the cutting unit 40 cuts the medium M. More specifically, for example, in a case where the medium M is paper, the cut matter D may be strips of paper, powder of paper and the like. The collection unit 50 is arranged downstream of the cutting unit 40 in the conveyance direction H, and upstream of the development units 10 and the transfer unit 20 in the conveyance direction H. In other words, the collection unit 50 is arranged between the cutting unit 40 and a group of the development units 10 and the transfer unit 20 in the conveyance direction H.

Descriptions are provided later for a detailed configuration of the collection unit 50 (see FIGS. 6 and 7).

(Conveyance Rollers)

The conveyance rollers 61 to 63 are members which convey the medium M along the conveyance passage P in the conveyance direction H. In this configuration, the conveyance rollers 61, 62 are arranged, for example, upstream of the cutting unit 40 in the conveyance direction H, while the conveyance roller 63 is arranged, for example, downstream of the fixation unit 30 in the conveyance direction H. The conveyance rollers 61 to 63 each include a pair of rollers which face each other with the conveyance passage P in between.

Among the constituents of the image formation apparatus, constituents including a word "roller" in their names, like the conveyance rollers 61 to 63, may be each a cylindrical member which extends in an X-axis direction, and which rotates around a rotational shaft extending in the X-axis direction.

(Control Board)

The control board 70 or a control unit includes, for example, a central processing unit (CPU), and controls the entirety of the image formation apparatus. In other words, the control board 70 performs the series of processes, including the process of forming the image on the medium M.

[Supplying Unit]

The supplying unit 200 supplies the medium M to the processing unit 100. Specifically, the supplying unit 200, for example, unwinds the medium M from its roll, and conveys the medium M along the conveyance passage P to input the medium M into the processing unit 100.

The supplying unit 200 includes, for example, a supplying shaft 210 inside a housing 201. The supplying shaft 210, for example, extends in the X-axis direction, and rotates around a rotational shaft extending in the X-axis direction. The medium M is wound around the supplying shaft 210 so that the medium M forms the shape of a roll. The supplying shaft 210 revolves to unwind the medium M from the roll, and supplies the medium M from the supplying unit 200 to the processing unit 100.

<1-2. Configuration of Development Units>

Figure 2:
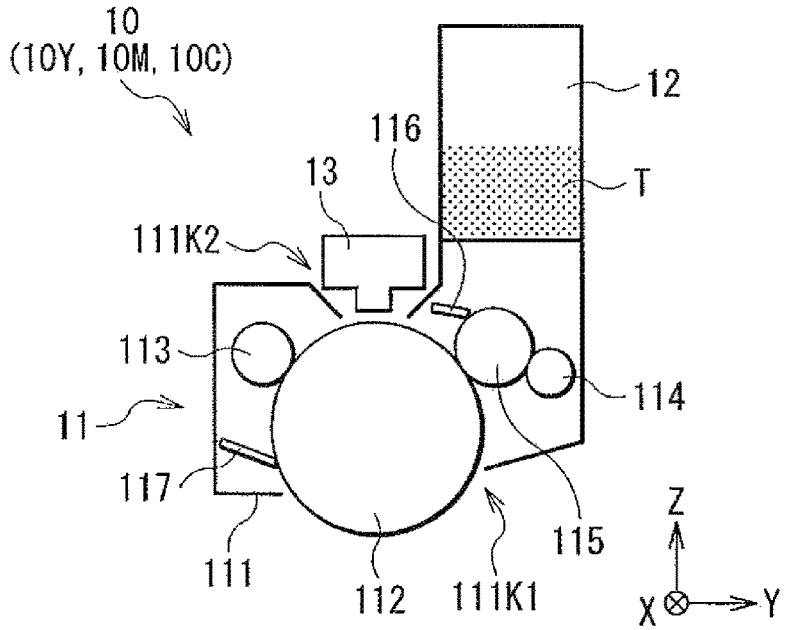
FIG. 2 is a schematic diagram illustrating an enlarged plan view of a configuration of a development unit, such as being illustrated in FIG. 1.

FIG. 2 is schematic diagram illustrating an enlarged plan view of a configuration of the development unit 10 (10Y, 10M, 10C), such as being illustrated in FIG. 1. As illustrated in FIG. 2, the development unit 10 includes, for example, a development processor 11, and a toner container 12. The toner container 12 is, for example, detachably attached to the development processor 11. For example, a light source 13 is added to the development processor 11.

[Development Processor]

The development processor 11 performs a development process using the toner T supplied from the toner container 12. The development processor 11 includes, for example, the photosensitive drum 112, a charging roller 113, a supplying roller 114, a development roller 115, a development blade 116 and a cleaning blade 117 inside a housing 111. The light source 13 is arranged, for example, outside the housing 111.

The housing 111 is provided, for example, with: an opening part 111K1 which partially exposes the photosensitive drum 112; and an opening part 111K2 which guides light emitted from the light source 13 to the photosensitive drum 112.

(Photosensitive Drum, Charging Roller, Supplying Roller, Development Roller)

The photosensitive drum 112 may be an organic photoconductor which carries the electrostatic latent image. The photosensitive drum 112 is, for example, a cylindrical member extending in the X-axis direction, and rotates around a rotational shaft extending in the X-axis direction. The charging roller 113 is put in pressure contact with the photosensitive drum 112, and charges the surface of the photosensitive drum 112. The supplying roller 114 is put in pressure contact with the development roller 115, and supplies the toner T to the surface of the development roller 115. The development roller 115 is put in pressure contact with the photosensitive drum 112, and carries the toner T which the supplying roller 114 supplies, as well as makes the toner T attach to the electrostatic latent image formed on the surface of the photosensitive drum 112.

(Development Blade)

The development blade 116 is a plate-shaped member which restricts the thickness of the toner T supplied to the surface of the development roller 115. The development blade 116 is arranged, for example, at a position way from the development roller 115 by a predetermined distance, and restricts the thickness of the toner T in response to the distance (gap) between the development roller 115 and the development blade 116.

(Cleaning Blade)

The cleaning blade 117 is a plate-shaped elastic member which scrapes away foreign matter, such as unwanted toner T remaining on the surface of the photosensitive drum 112. The cleaning blade 117, for example, extends in a direction substantially in parallel with the extension direction of the photosensitive drum 112, and is put in pressure contact with the photosensitive drum 112.

[Toner Container]

The toner container 12 is a member which contains the toner T, and is a so-called toner cartridge. The toner container 12 in the development unit 10Y contains, for example, yellow toner. The toner container 12 in the development unit 10M contains, for example, magenta toner. The toner container 12 in the development unit 10C contains, for example, cyan toner.

[Light Source]

The light source 13 is an exposure unit which exposes the surface of the photosensitive drum 112 to form the electrostatic latent image on the surface of the photosensitive drum 112. The light source 13 is, for example, a light-emitting diode (LED) head which includes an LED element and a lens array.

<1-3. Configuration of Cutting Unit>

Figure 3:
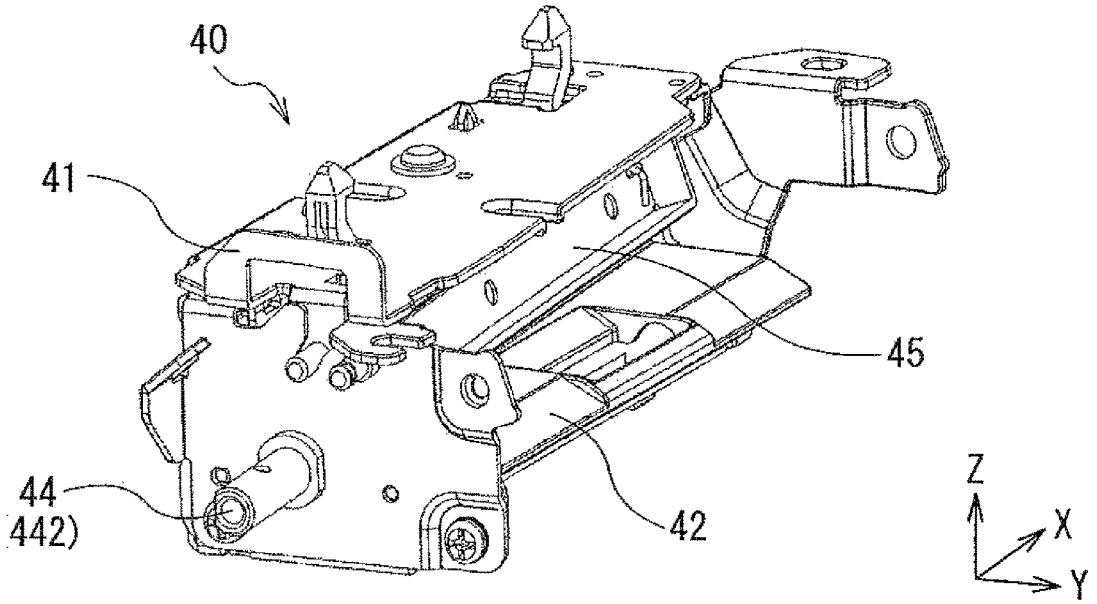
FIG. 3 is a diagram illustrating an enlarged perspective view of a configuration of a cutting unit, such as being illustrated in FIG. 1.
Figure 4:
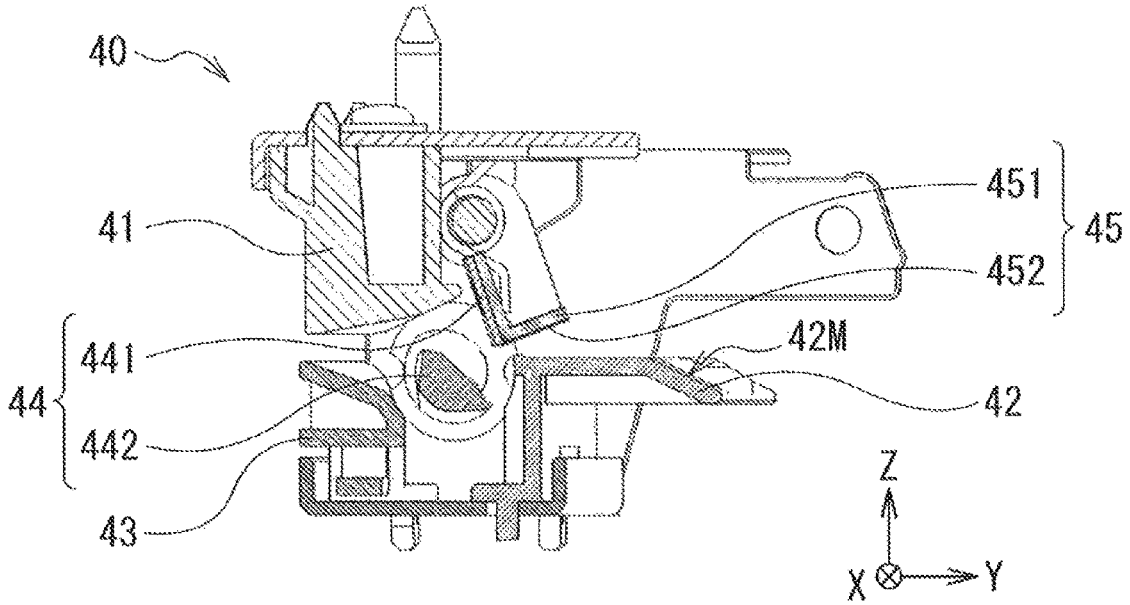
FIG. 4 is a diagram illustrating a cross-sectional view of the configuration of the cutting unit, such as being illustrated in FIG. 3.

FIG. 3 is a diagram illustrating an enlarged perspective view of a configuration of the cutting unit 40, such as being illustrated in FIG. 1. FIG. 4 a diagram illustrating a cross-sectional view of the configuration of the cutting unit 40, such as being illustrated in FIG. 3. FIG. 5 a diagram illustrating an enlarged cross-sectional view of a configuration of a main part of the cutting unit 40, such as being illustrated in FIG. 4. Note that FIGS. 4 and 5 illustrate the cross section of the cutting unit 40 taken along a YZ plane, and FIG. 5 additionally illustrates part of the conveyance passage P.

As discussed above, the cutting unit 40 includes, for example, the rotary cutter, and cuts the medium M while conveying the medium M. Specifically, as illustrated in FIGS. 3 to 5, the cutting unit 40 includes, for example, an upstream guide 42, a downstream guide 43, a cutter 44 and the intermediate guide 45 inside a substantially box-shaped housing 41. The upstream guide 42, the downstream guide 43 and an intermediate guide 45 are fixed to the housing 41, while a part (a rotary blade 442, which is described later) of the cutter 44 is rotatably supported by the housing 41. In this respect, the upstream guide 42 may be referred to as a "first guide member" according to an aspect of one or more embodiments of the disclosure; the intermediate guide 45 may be referred to as a "second guide member" according to an aspect of one or more embodiments of the disclosure; and the cutter 44 may be referred to as a "cutting member" according to an aspect of one or more embodiments of the disclosure.

[Upstream Guide]

The upstream guide 42 is a member which supports and concurrently guides the medium M, which is going to be cut by the cutting unit 40, toward the cutter 44 while the medium M is being conveyed along the conveyance passage P in the conveyance direction H. The upstream guide 42 is arranged upstream of the cutter 44 in the conveyance direction H, and includes a support surface 42M which supports the medium M.

Specifically, the upstream guide 42 includes, for example, an inclined guide part 421 and a flat guide part 422. The inclined guide part 421 is located upstream of the flat guide part 422 in the conveyance direction H, and is inclined such that as the inclined guide part 421 becomes closer to the flat guide part 422, the inclined guide part 421 becomes higher than its portion which becomes farther from the flat guide part 422 in the conveyance direction H. The flat guide part 422 is located downstream of the inclined guide part 421 in the conveyance direction H, and is connected to the inclined guide part 421. Thereby, the support surface 42M in the inclined guide part 421 is, for example, a surface (inclined surface) inclined to the Y-axis direction, while the support surface 42M in the flat guide part 422 is, for example, a surface (flat surface) extending in the Y-axis direction.

Particularly, the flat guide part 422 is provided, for example, with an inclined part 46, and the inclined part 46 is inclined such that a downstream side of the inclined part 46 in the conveyance direction H is higher than an upstream side of the inclined part 46 in the conveyance direction H. In other words, the inclined part 46 is inclined such that a portion of the inclined part 46 closer to the intermediate guide 45 becomes higher than a portion of the inclined part 46 farther from the intermediate guide 45. In this configuration, the projection-shaped inclined part 46 is provided, for example, in a downstream end portion of the flat guide part 422 in the conveyance direction H. The inclined part 46 includes a surface (an inclined surface 46M) in which the downstream side in the conveyance direction H is higher than the upstream side in the conveyance direction H.

The inclined part 46 plays a role as a jumping ramp which, while the medium M is being conveyed toward the cutter 44 while supported by the support surface 42M, raises the medium M to bring the medium M closer to the intermediate guide 45. Thus, the use of the inclined part 46 (the inclined surface 46M) guides the medium M to come closer to the intermediate guide 45, and makes it easy for the medium M to come into contact with the intermediate guide 45 (a guide plate 452, which is described later) intentionally and actively.

[Downstream Guide]

The downstream guide 43 is a member which guides the medium M, cut by the cutter 44, toward the collection unit 50. The downstream guide 43 is arranged downstream of the cutter 44 in the conveyance direction H, and guides the medium M, cut by the cutter 44, toward the collection unit 50 while supporting the medium M.

[Cutter]

The cutter 44 is a member which cuts the medium M, and is, for example, the rotary cutter, as discussed above. Specifically, the cutter 44 includes, for example, a fixed blade 441 (or a stationary blade) and the rotary blade 442. The fixed blade 441 and the rotary blade 442 are physically separated from each other, and face each other with the conveyance passage P in between. In this respect, the fixed blade 441 may be referred to as a "first cutting member" according to an aspect of one or more embodiments of the disclosure, and the rotary blade 442 may be referred to as a "second cutting member" according to an aspect of one or more embodiments of the disclosure.

The fixed blade 441 is a plate-shaped member which faces the rotary blade 442, and which includes a cutting edge in its portion in contact with the medium M. The fixed blade 441 is fixed. The fixed blade 441 is held, for example, by a holder 451, as described later.

The rotary blade 442 is a cylindrical member which includes a spiral edge provided on a surface of its cylinder extending in the X-axis direction, and rotates around a rotational shaft extending in the X-axis direction. In the cutter 44, while the medium M guided by the upstream guide 42 and the intermediate guide 45 is passing between the fixed blade 441 and the rotary blade 442, the rotary blade 442 rotates while in contact with the fixed blade 441 to cut the medium M. FIG. 5 illustrates a cross section of the cutter 44 in a position where the rotary blade 442 is not in contact with the fixed blade 441.

[Intermediate Guide]

The intermediate guide 45 is a member which, while the upstream guide 42 is guiding the medium M toward the cutter 44, further guides the medium M toward the cutter 44. The intermediate guide 45 is arranged between the upstream guide 42 and the cutter 44 in the conveyance direction H. More specifically, the intermediate guide 45 is arranged such that the intermediate guide 45 becomes away from the upstream guide 42 in a direction in which the upstream guide 42 guides the medium M. The direction in which the upstream guide 42 guides the medium M means, for example, a direction (a guide direction L) along the inclined surface 46M in the inclined part 46 in the case where the upstream guide 42 (the flat guide part 422) is provided with the inclined part 46. FIG. 5 illustrates the guide direction L with a dashed line. Thus, as described later, while the upstream guide 42 is guiding the medium M up to the cutter 44 via the intermediate guide 45, the medium M is intentionally and actively brought into contact with the intermediate guide 45 (a guide plate 452, which is described later)(see FIG. 9).

Specifically, the intermediate guide 45 includes, for example, the holder 451 and the guide plate 452. In this respect, the holder 451 may be referred to as a "holding member" according to an aspect of one or more embodiments of the disclosure, and the guide plate 452 may be referred to as a "covering member" according to an aspect of one or more embodiments of the disclosure.

The holder 451 holds, for example, the fixed blade 441, and the fixed blade 441 is welded, for example, to the holder 451. Since the holder 451 holds the fixed blade 441, the fixed blade 441, the holder 451 and the guide plate 452 forms a so-called fixed blade unit. In this configuration, a taper is provided, for example, to part of the holder 451, and a space 45S is provided between the holder 451 and the fixed blade 441.

The guide plate 452 is a plate-shaped member which covers the holder 451 and part of the fixed blade 441 on its side facing the upstream guide 42, that is to say, its side closer to the upstream guide 42. The guide plate 452 is joined to the holder 451, for example, with a piece of two-sided tape. The purpose of covering the holder 451 and part of the fixed blade 441 with the guide plate 452, that is to say, covering only part of the fixed blade 441 with the guide plate 452 is to prevent the rotary blade 442 from becoming less likely to comes into contact with the fixed blade 441 due to the existence of the guide plate 452.

The guide plate 452 includes a contact surface 45M with which the medium M guided by the upstream guide 42 comes into contact. The contact surface 45M is inclined such that a downstream side of the contact surface 45M in the conveyance direction H is lower than an upstream side of the contact surface 45M in the conveyance direction H. This is because, after coming into contact with the contact surface 45M, the medium M guided by the upstream guide 42 is easily guided to the cutter 44.

The guide plate 452 may be a rigid sheet or a pliable (flexible) film. In this configuration, the guide plate 452 is, for example, a pliable film, and is therefore a so-called film guide.

<1-4. Configuration of Collection Unit>

Figure 6:
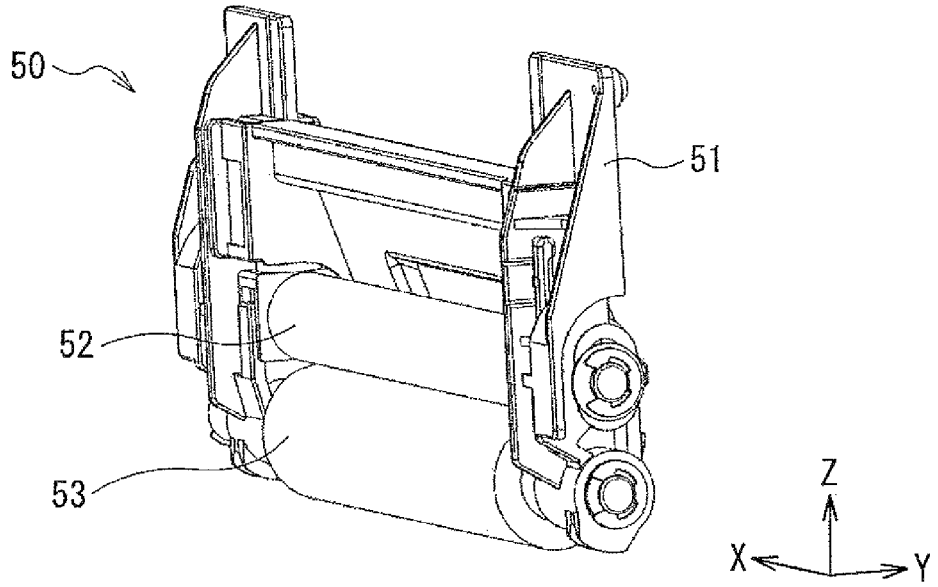
FIG. 6 is a diagram illustrating an enlarged perspective view of a configuration of a collection unit, such as being illustrated in FIG. 1.

FIG. 6 is a diagram illustrating an enlarged perspective view of a configuration of the collection unit 50, such as being illustrated in FIG. 1. FIG. 7 is a diagram illustrating a cross-sectional view of the configuration of the collection unit 50, such as being illustrated in FIG. 6. FIG. 7 additionally illustrates a part of the conveyance passage P.

Figure 7:
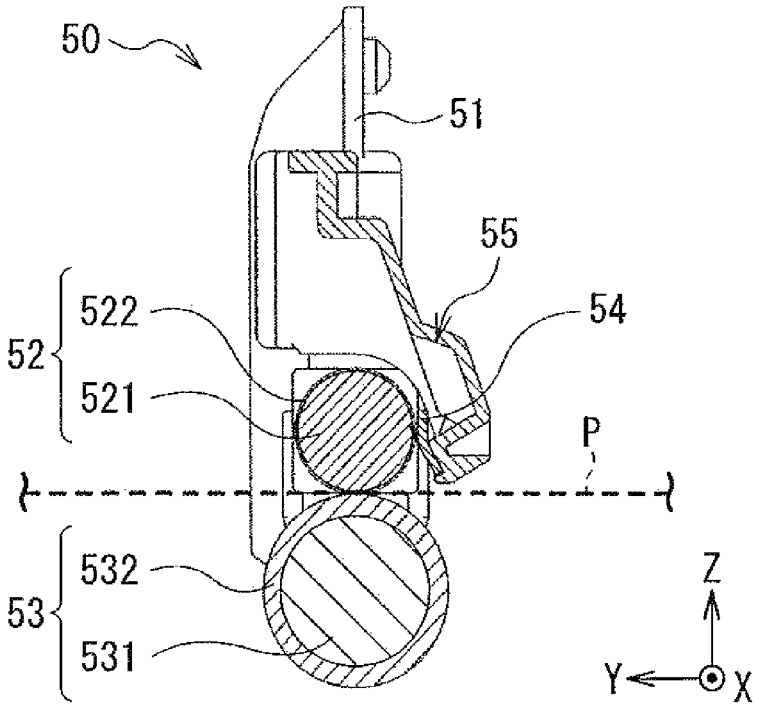
FIG. 7 is a diagram illustrating a cross-sectional view of the configuration of the collection unit, such as being illustrated in FIG. 6.

As illustrated in FIGS. 6 and 7, the collection unit 50 includes, for example, a pressure roller 52, a resist roller 53 and a scraper 54 inside a housing 51. While the medium M cut by the cutting unit 40 is being conveyed via the collection unit 50, the pressure roller 52 and the resist roller 53 are brought into pressure contact with each other with the medium M in between. The pressure roller 52 and the resist roller 53 are rotatably supported by the housing 51, while the scraper 54 is fixed to the housing 51. A collection chamber 55 is provided inside the housing 51. In this respect, the pressure roller 52 may be referred to as a "first pressure contact member" according to an aspect of one or more embodiments of the disclosure; the resist roller 53 may be referred to as a "second pressure contact member" according to an aspect of one or more embodiments of the disclosure; and the scraper 54 may be referred to as a "plate-shaped member" or a "remover" according to an aspect of one or more embodiments of the disclosure.

[Pressure Roller]

The pressure roller 52 is a member which collects the cut matter D which is produced when the cutting unit 40 cuts the medium M, and is brought into pressure contact with the resist roller 53. The pressure roller 52 rotates, for example, around the rotational shaft extending in the X-axis direction, as described above. Specifically, the pressure roller 52 includes, for example, a shaft 521 and a surface layer 522. The shaft 521 is a cylindrical member extending in the X-axis direction, and contains one or more metal materials, such as stainless steel. The surface layer 522 covers a surface of a shaft 521.

[Resist Roller]

The resist roller 53 is a member with which the pressure roller 52 is put in pressure contact, and rotates, for example, around the rotational shaft extending in the X-axis direction, as described above. Specifically, the resist roller 53 includes, for example, a shaft 531 and a surface layer 532. The shaft 531 is a cylindrical member extending in the X-axis direction, and contains, for example, the same material as the shaft 521 is formed from. The surface layer 532 covers the surface of the shaft 531.

[Scraper]

The scraper 54 is a plate-shaped member which scrapes away the cut matter D collected by the pressure roller 52, that is to say, the cut matter D which attaches to the surface of the pressure roller 52. The scraper 54 is put in pressure contact, for example, with the pressure roller 52. The cut matter D scraped away by the scraper 54 is collected into the collection chamber 55 which serves as a storage chamber for the cut matter D.

<1-5. Polarities of Main Constituents>

In the image formation apparatus, polarities of the main constituents (material) involved in the cutting process and the collection process are optimized in order that the collection unit 50 can easily collect the cut matter D which is produced when the cutting unit 40 cuts the medium M. The following descriptions are provided for what polarities the main constituents have in a case where the medium M is, for example, paper and has a positive polarity.

[Polarity of Cutter]

In the cutting unit 40, the polarity of the cutter 44 is optimized. Specifically, the cutter 44 (the fixed blade 441 and the rotary blade 442) has a polarity opposite to that of the medium M in a triboelectric series. In other words, for example, in the case where the medium M has the positive polarity, the fixed blade 441 and the rotary blade 442 each have the negative polarity.

For the purpose of obtaining the negative polarity, the fixed blade 441 and the rotary blade 442 each contain one or more metal materials, such as stainless steel (SUS).

The cutting unit 40 including the cutter 44 is, for example, electrically isolated from its surroundings with high resistance (for example, 500 MΩ) inside the image formation apparatus. The purpose for this is to prevent electric charge from escaping from the cutting unit 40 to the surroundings. A varistor may be connected to the cutting unit 40 for the same purpose.

[Polarities of Pressure Roller and Resist Rollers]

In the collection unit 50, too, the polarities of the pressure roller 52 and the resist roller 53 are optimized. Specifically, the pressure roller 52 has a polarity opposite to that of the medium M in the triboelectric series, while the resist roller 53 has a polarity value which is shifted from a polarity value of the pressure roller 52 toward the polarity of the medium M in the triboelectric series. In other words, for example, in the case where the medium M has the positive polarity, the pressure roller 52 has the negative polarity. Meanwhile, for example, in the case where the medium M has the positive polarity, the resist roller 53 has a polarity corresponding to a value which is shifted from a negative value of the pressure roller 52 toward the positive polarity. The polarity value of the resist roller 53, therefore, may be a positive polarity value or a negative polarity value as long as the polarity value of the resist roller 53 is greater than the negative polarity value of the pressure roller 52.

For the purpose of obtaining the negative polarity, the surface layer 522 which determines the polarity of the surface of the pressure roller 52 contains, for example, one or more high polymer materials (rubber materials), such as urethane. In addition, for the purpose of obtaining the polarity corresponding to the value which is shifted from the negative polarity value of the pressure roller 52 toward the positive polarity, the surface layer 532 which determines the polarity of the surface of the resist roller 53 contains, for example, one or more high polymer materials (rubber materials), such as ethylene propylene diene rubber (EPDM).

The reason why the cutter 44, the pressure roller 52 and the resist roller 53 have the respective polarities discussed above is that as discussed above, the use of the difference among the polarities of the medium M, the cutter 44 and the pressure roller 52 makes it easy for the cut matter D to be collected by the pressure roller 52. Detailed descriptions are provided later for the reason why the use of the polarity difference makes it easy for the cut matter D to be collected by the pressure roller 52.

[Polarity of Scraper]

In addition, it is preferable that the scraper 54 have a polarity opposite to that of the medium M in the triboelectric series. Specifically, in the case where the medium M has the positive polarity, it is preferable that the scraper 54 have the negative polarity. This is because the use of the difference between the polarities of the medium M and the scraper 54 makes it easy for the cutter matte D to be collected by not only the pressure roller 52 but also the scraper 54.

Particularly, it is preferable that the absolute value of a polarity value of the scraper 54 be greater than the absolute value of a polarity value of the pressure roller 52. In other words, in a case where the pressure roller 52 has, for example, the negative polarity, it is preferable that the scraper 54 have the negative polarity stronger than the negative polarity of the pressure roller 52. The reason for this is as follows. This facilitates the movement of the cut matter D collected by the pressure roller 52 onto the scraper 54, and makes the cut matter D on the scraper 54 less likely to return onto the medium M. Accordingly, the cut matter D is more easily collected by the collection unit 50.

For the purpose of obtaining the negative polarity, the scraper 54 contains, for example, one or more high polymer materials, such as tetrafluoroethylene perfluoroalkyl vinyl ether copolymer (PFA).

[Polarities of Upstream Guide and Guide Plate]

Furthermore, it is preferable that the upstream guide 42 have a polarity opposite to that of the medium M in the triboelectric series. In other words, in the case where the medium M has the positive polarity, it is preferable that the upstream guide 42 have the negative polarity. This is because the use of the difference between the polarities of the medium M and the upstream guide 42 raises the polarity value of the medium M having the positive polarity, that is to say, increases the amount of charge on the medium M having the positive polarity. Thereby, the use of the difference between the polarities between the medium M and the pressure roller 52 makes it easier for the cut matter D to be collected by the pressure roller 52.

For the purpose of obtaining the negative polarity, the upstream guide 42 contains, for example, one or more high polymer materials, such as acrylonitrile butadiene styrene copolymer (ABS).

Furthermore, it is preferable that the intermediate guide 45, more specifically, the guide plate 452 with which the medium M comes into contact, have a polarity opposite to that of the medium M in the triboelectric series. In other words, in the case where the medium M has the positive polarity, it is preferable that the guide plate 452 have the negative polarity. This is because for the same reason as the upstream guide 42, the cut matter D is easily collected by the pressure roller 52.

For the purpose of obtaining the negative polarity, the guide plate 452 contains, for example, one or more high polymer materials, such as polyethylene terephthalate (PET). For example, in a case where the guide plate 452 is a film, the guide plate 452 is a film made of PET or the like.

<1-6. Working>

Figure 5:
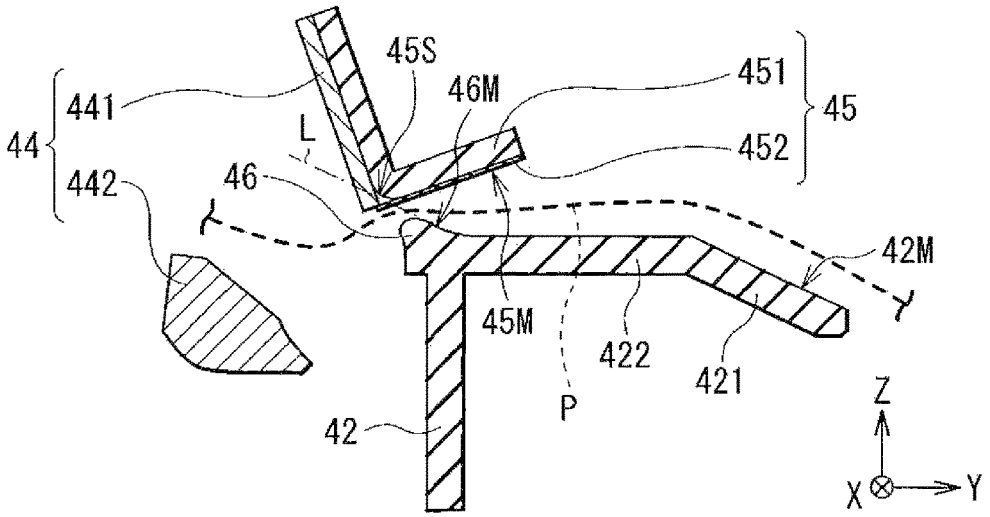
FIG. 5 is a diagram illustrating an enlarged cross-sectional view of a configuration of a main part of the cutting unit, such as being illustrated in FIG. 4.
Figure 8:
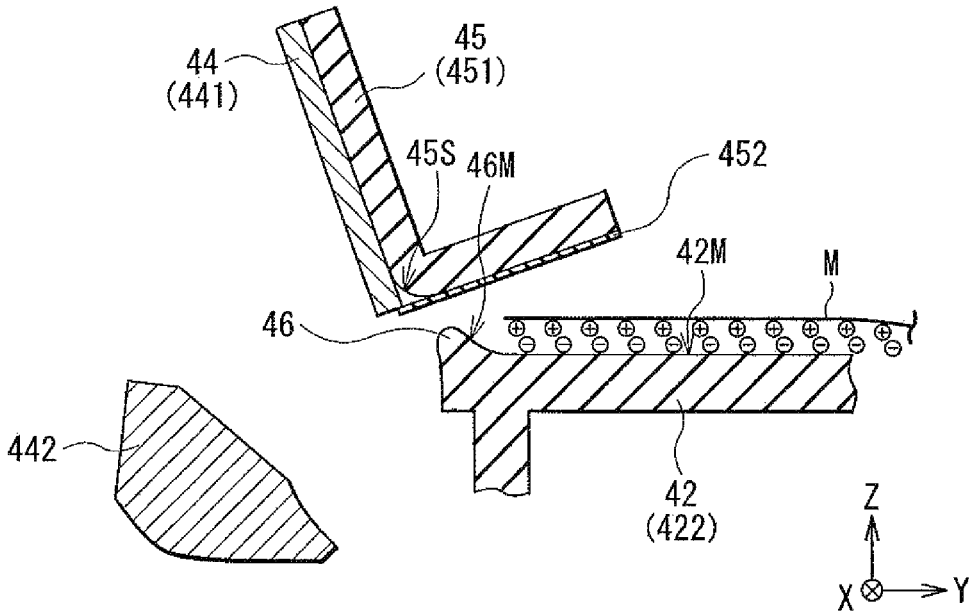
FIG. 8 is a diagram illustrating a cross-sectional view for explaining how the cutting unit works.
Figure 9:
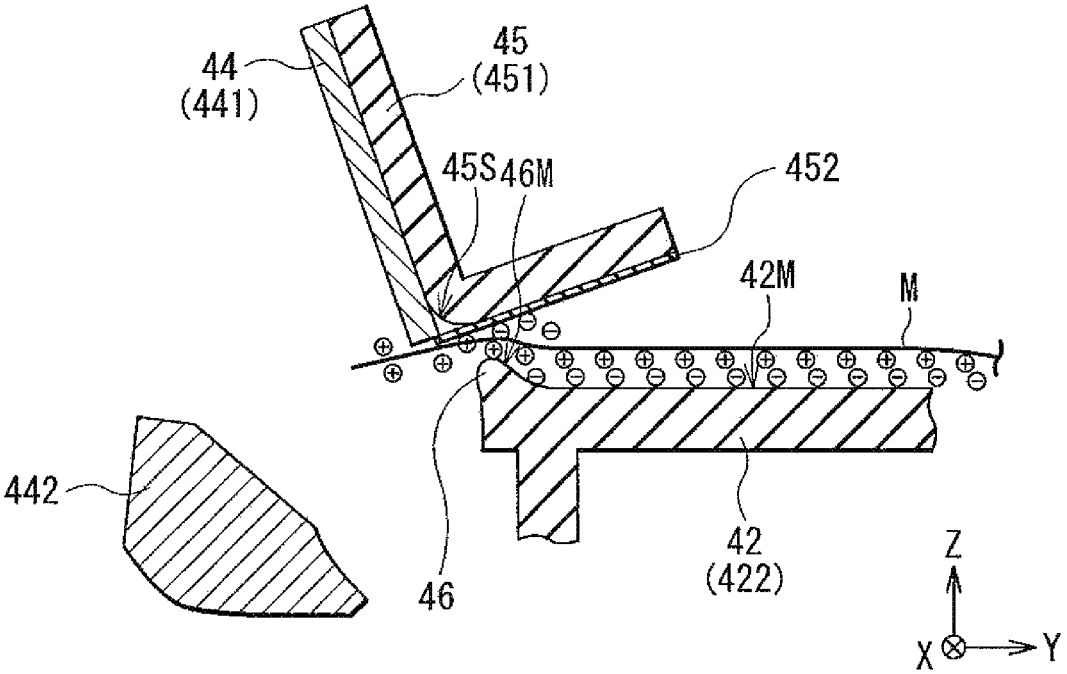
FIG. 9 is a diagram illustrating a cross-sectional view for explaining how the cutting unit works continuing from FIG. 8.
Figure 10:
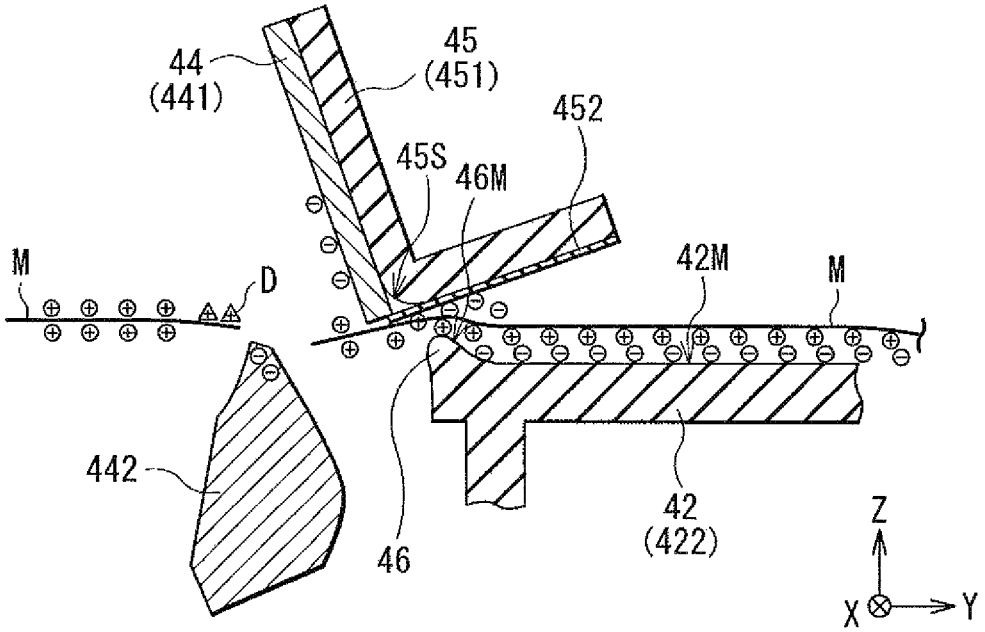
FIG. 10 is a diagram illustrating a cross-sectional view for explaining how the cutting unit works continuing from FIG. 9.

FIGS. 8 to 10 are each a diagram illustrating an enlarged cross-sectional view of a part of the configuration of the cutting unit 40, such as being illustrated in FIG. 5, for the purpose of explaining how the cutting unit 40 works. FIGS. 11 to 14 are each a schematic diagram illustrating an enlarged cross-sectional view of a part of the configuration of the collection unit 50, such as being illustrated in FIG. 7, for the purpose of explaining how the collection unit 50 works.

FIGS. 8 to 14 each additionally illustrate electrically charged particles which occur in the cutting process and the collection process. Electrically charged particles with encircled plus symbols are electrically charged particles of the medium M and the like which have the positive polarity. Electrically charged particles with encircled minus symbols are electrically charged particles of the cutter 44 and the like which have the negative polarity. Electrically charged particles with plus symbols surrounded by triangles are electrically charged particles of the cut matter D which has the positive polarity.

In this respect, to begin with, descriptions are provided for how the image formation apparatus works to form an image, and then, descriptions are provided for how the image formation apparatus works to collect the cut matter D. In the following descriptions, FIGS. 1 to 7, which have already been discussed, are referred to depending on the necessity.

[Working to Form Image]

In order to form an image on the medium M, the image formation apparatus, for example, performs the cutting process, the development process, the transfer process and the fixing process in this order, and performs the cleaning process when needed, as described below.

(Cutting Process)

The supplying shaft 210 rotates in the supplying unit 200. Thereby, the media M are continuously supplied from the supplying unit 200 to the processing unit 100. In the cutting process, in the cutting unit 40, the rotary blade 442 rotates while in contact with the fixed blade 441. Thereby, the cutter 44 cuts the media M while the media M are being conveyed.

(Development Process)

Once each medium M, cut by the cutting unit 40, is inputted into the development unit 10, the development processor 11 works for the development process in which: the photosensitive drum 112 rotates; and the charging roller 113 applies a direct-current voltage to the photosensitive drum 112 depending on its rotation to evenly electrically charge the photosensitive drum 112. Thereafter, once the light source 13 emits light onto the photosensitive drum 112 based on data on the image, an electric potential is attenuated (light is attenuated) in the light-emitted area to form an electrostatic latent image. The data on the image is transmitted to the image formation apparatus, for example, from an external apparatus such as a personal computer.

In the development processor 11, the supplying roller 114 and the development roller 115 rotate in response to the voltage application, and the toner T is supplied from the supplying roller 114 to the development roller 115. Furthermore, once the photosensitive drum 112 rotates, the toner T moves from the development roller 115 to the photosensitive drum 112, and attaches a toner T to the photosensitive drum 112 (the electrostatic latent image). During this event, the development blade 116 removes part of the toner T to equalize the thickness of the toner T.

Note that the toner T is agitated in the toner container 12, and is supplied from the toner container 12 to the development processor 11.

(Transfer Process)

In the transfer unit 20, once the driving roller 22 rotates, the driven roller 23 rotates in response to the rotation of the driving roller 22, and the conveyance belt 21 moves. In the development process, since the transfer roller 24 is put in pressure contact with the photosensitive drum 112 with the conveyance belt 21 in between, once a voltage is applied to the transfer roller 24, the transfer roller 24 transfers the toner T, which attaches to the photosensitive drum 112 in the development process, to the medium M.

(Fixing Process)

In the fixing process, in the fixation unit 30, the medium M passes between the heating roller 31 and the pressure roller 32. During this event, the heating roller 31 heats the toner T transferred onto the medium M, and thus fuses the toner T. Meanwhile, the pressure roller 32 presses the fused toner T against the medium M, and brings the toner T into close contact with the medium M.

Thereby, the toner T is fixed onto the medium M so as to form the image on the medium M. The medium M with the image formed thereon is discharged through the discharge port 101E. The types and number of toners T to be used to form the image is determined depending on the combination of the colors needed to form the image.

(Cleaning Process)

In the development unit 10, the photosensitive drum 112 rotates while in pressure contact with the cleaning blade 117, and the cleaning blade 117 scrapes away foreign matter, like unwanted toner T remaining on the surface of the photosensitive drum 112.

Furthermore, in the transfer unit 20, while the conveyance belt 21 is moving, the cleaning blade 25 scrapes away foreign matter, like unwanted toner T remaining on the surface of the conveyance belt 21, and the foreign matter is collected into the collection box 26.

[Process of Collecting Cut Matter]

While forming the image on the medium M, the image formation apparatus performs the process of collecting the cut matter D, as described below. Since the medium M is, for example, paper as discussed above, the following descriptions are provided for how the image formation apparatus works in the case where the medium M has the positive polarity.

To begin with, once the medium M is supplied from the supplying unit 200 to the processing unit 100 (the cutting unit 40), the conveyance belt 21 conveys the medium M along the conveyance passage P in the conveyance direction H, and the medium M reaches the upstream guide 42. Thereby, as illustrated in FIG. 8, the medium M is conveyed while supported by the upstream guide 42 due to its weight. Thus, the medium M is guided toward the cutter 44 while in contact with (frictionally sliding over) the support surface 42M.

During this event, the upstream guide 42 is electrically charged with the polarity (negative polarity) opposite to the polarity (positive polarity) of the medium M due to the relationship (in the triboelectric series) between the material of the medium M and the material of the upstream guide 42, and the medium M is accordingly easy to charge positively.

Subsequently, since the intermediate guide 45 (the guide plate 452) is arranged in the guide direction L, the medium M comes into contact with the guide plate 452, as illustrated in FIG. 9, while the intermediate guide 45 is guiding the medium M toward the cutter 44.

During this event, since the upstream guide 42 (the flat guide part 422) is provided with the inclined part 46, the upstream guide 42 guides the medium M using the inclined surface 46M of the inclined part 46 such that the medium M comes closer to the guide plate 452. Thereby, the medium M easily comes into contact with the guide plate 452 before reaching the cutter 44.

In addition, since for example, the guide plate 452 is electrically charged with the polarity (the negative polarity) opposite to the polarity (the positive polarity) of the medium M due to the relationship (in the triboelectric series) between the material of the medium M and the material of the guide plate 452, the medium M is positively charged easily.

Furthermore, since the guide plate 452 covers not only the holder 451 but also part of the fixed blade 441, the medium M is less likely to get into the space 45S while guided toward the cutter 44 after coming into contact with the guide plate 452. Thereby, the medium M is less likely to get caught by the space 45S while guided toward the cutter 44, and the medium M is easily guided up to the cutter 44 smoothly. In other words, even in the case where the medium M comes into contact with the guide plate 452, the medium M is easily guided up to the cutter 44 smoothly, and the occurrence of the so-called jamming is inhibited.

Thereafter, while the medium M is passing between the fixed blade 441 and the rotary blade 442, the rotary blade 442 rotates leftward while in contact with the fixed blade 441, and the cutter 44 cuts the medium M (the cutting process), as illustrated in FIG. 10. The conveyance belt 21 conveys the medium M, cut by the cutter 44, toward the collection unit 50.

During this event, the cutter 44 (the fixed blade 441 and the rotary blade 442) is electrically charged with the polarity (the negative polarity) opposite to the polarity (the positive polarity) of the medium M due to the relationship (in the triboelectric series) between the material of the medium M and the material of the cutter 44. Accordingly, the medium M is positively charged easily.

In the cutting process, the cut matter D is produced when the cutter 44 cuts the medium M, and is electrically charged with the same polarity (the positive polarity) as the medium M.

Figure 11:
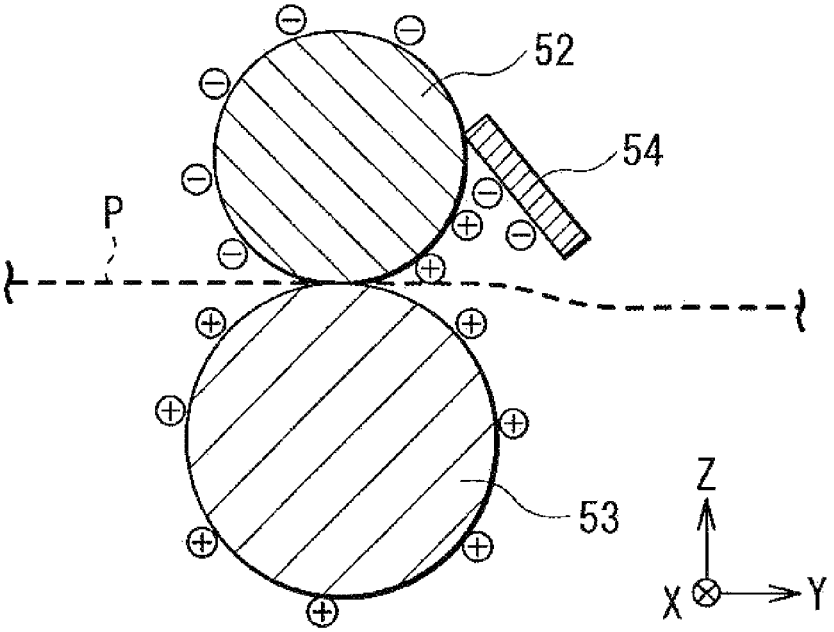
FIG. 11 is a diagram illustrating a cross-sectional view for explaining how the collection unit works.

Subsequently, the medium M cut by the cutting unit 40 is inputted into the collection unit 50. In the collection unit 50, as illustrated in FIG. 11, the pressure roller 52 is electrically charged with the polarity (the negative polarity) opposite to the polarity of the medium M due to the relationship (in the triboelectric series) between the material of the pressure roller 52 and the material of the resist roller 53, while the resist roller 53 has the polarity value which is shifted from the polarity value of the pressure roller 52 toward the polarity of the medium M. FIG. 11 illustrates, for example, the case where the resist roller 53 is positively charged.

Furthermore, for example, the scraper 54 is electrically charged with the polarity (the negative polarity) opposite to the polarity (the positive polarity) of the medium M due to the relationship (in the triboelectric series) between the material of the medium M and the material of the scraper 54. In other words, the scraper 54, put in pressure contact with the pressure roller 52, is electrically charged, for example, with the same polarity (the negative polarity) as the pressure roller 52 is.

Figure 12:
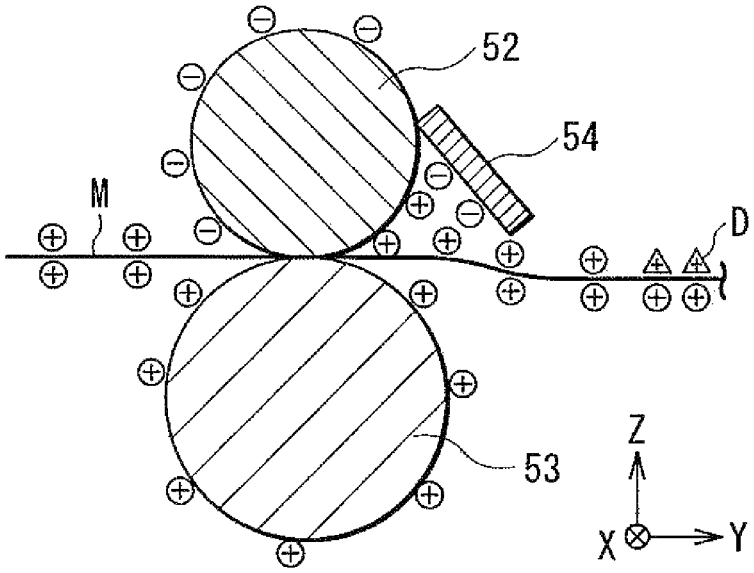
FIG. 12 is a diagram illustrating a cross-sectional view for explaining how the collection unit works continuing from FIG. 11.

The pressure roller 52 is put in pressure contact with the resist roller 53. Thus, while the pressure roller 52 is rotating rightward and the resist roller 53 is rotating leftward, as illustrated in FIG. 12, the medium M passes between the pressure roller 52 and the resist roller 53, and is conveyed toward the development units 10 and the transfer unit 20 (see FIG. 1).

During this event, as discussed above, the medium M is positively charged, while the pressure roller 52 and the scraper 54 are negatively charged.

Figure 13:
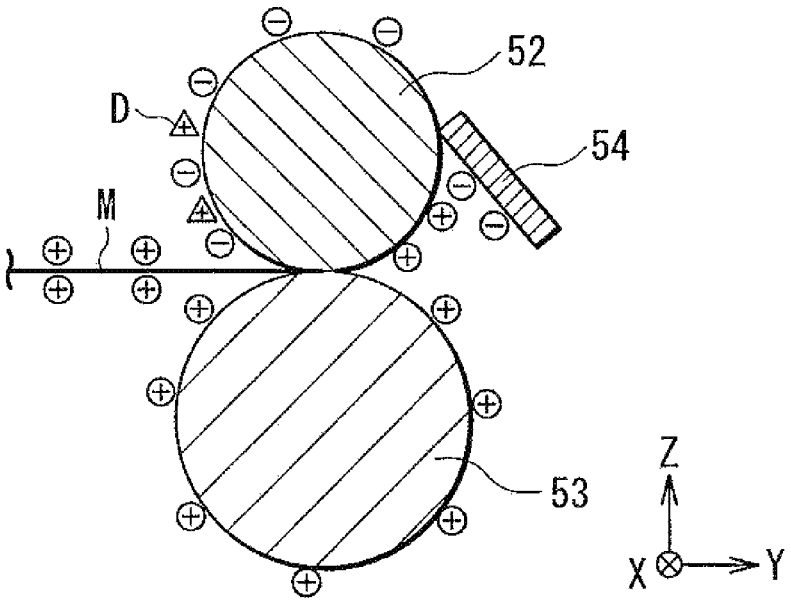
FIG. 13 is a diagram illustrating a cross-sectional view for explaining how the collection unit works continuing from FIG. 12.

Finally, when the medium M is conveyed to reach the pressure roller 52, as illustrated in FIG. 13, the use of the difference between the polarity (the positive polarity) of the cut matter D and the polarity (the negative polarity) of the pressure roller 52 makes the cut matter D comes off the medium M and attach to the pressure roller 52. Thereby, the pressure roller 52 collects the cut matter D.

During this event, the use of the difference between the polarity (the negative polarity) of the pressure roller 52 and the polarity (the polarity having the value which is shifted from the negative polarity value of the pressure roller 52 toward the positive polarity) of the resist roller 53 makes the cut matter D move from the medium M more easily to the pressure roller 52 than to the resist roller 53.

The pressure roller 52 collects the cut matter D, and rotates with the scraper 54 put in pressure contact with the pressure roller 52. Thereby, the scraper 54 scrapes away the cut matter D which attaches to the pressure roller 52, and the cut matter D is collected into the collection chamber 55.

Figure 14:
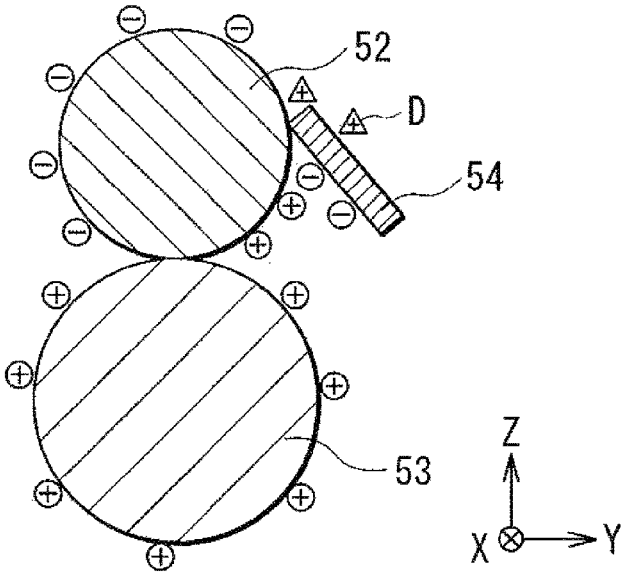
FIG. 14 is a diagram illustrating a cross-sectional view for explaining how the collection unit works continuing from FIG. 13.

During this event, as illustrated in FIG. 14, the use of the difference between the polarity (the positive polarity) of the cut matter D and the polarity (the negative polarity) of the scraper 54 moves the cut matter D from the pressure roller 52 to the scraper 54. In other words, the cut matter D physically scraped away by the scraper 54 is collected into the collection chamber 55, while the cutter matter D not physically scraped away by the scraper 54 electrically attaches to the scraper 54. This makes the cut matter D, collected by the pressure roller 52, less likely to return to the medium M.

Particularly, in the case where the absolute value of the polarity value of the scraper 54 is greater than the absolute value of the polarity value of the pressure roller 52, the use of the difference between the polarity value of the pressure roller 52 and the polarity value of the scraper 54 makes the cut matter D easily move from the pressure roller 52 to the scraper 54. This makes the cut matter D collected by the pressure roller 52 less likely to return to the medium M.

Thus, even in the case where the cut matter D is produced when the cutting unit 40 cuts the medium M, the collection unit 50 collects the cut matter D. The collection process of collecting the cut matter D ends with this.

<1-7. Operation and Effects>

Regarding the image formation apparatus, in the cutting unit 40 including the cutter 44, the cutter 44 has the polarity opposite to that of the medium M in the triboelectric series. Meanwhile, in the cutting unit 40 including the pressure roller 52 and the resist roller 53, the pressure roller 52 has the polarity opposite to that of the medium M in the triboelectric series, while the resist roller 53 had the polarity value which is shifted from the polarity value of the pressure roller 52 toward the polarity of the medium M in the triboelectric series.

In this case, for example, if the medium M has the positive polarity, the use of the difference between the polarity of the medium M and the polarity of the cutter 44 makes it easy to charge the medium M positively, and accordingly to charge the cut matter D positively as well, before the medium M cut by the cutting unit 40 is inputted into the collection unit 50. In other words, the use of the polarity difference makes the amount of charge on the medium M having the positive polarity, and accordingly the amount of charge on the cut matter D having the positive polarity, become larger than no use of the polarity difference which results from the medium M and the cutter 44 having the same polarity. This sufficiently positively charges the medium M, and the thus-charged medium M is inputted into the collection unit 50.

In addition, once the medium M cut by the cutting unit 40 is inputted into the collection unit 50, the use of the difference between the polarity of the cut matter D and the polarity of the pressure roller 52 electrically moves the cut matter D from the medium M to the pressure roller 52, and the pressure roller 52 collects the cut matter D. During this event, the above-discussed increase in the amount of charge on the cut matter D having the positive polarity makes it easy for the pressure roller 52 to collect the cut matter D.

For the above reasons, the collection unit 50 sufficiently collects the cut matter D, and accordingly decreases the amount of cut matter D which may attach to the medium M which is going to be inputted into the development units 10 and the transfer unit 20, even in the case where the cut matter D is produced when the cutting unit 40 cuts the medium M. Thus, the decreased amount of cut matter D has less influence on the quality of the image. More specifically, since the amount of cut matter D still attaching to the medium M is smaller, the quality of the image less deteriorates due to smear and the like. Accordingly, the image formation apparatus can stably form the image on the medium M.

Particularly, since the scraper 54 has the polarity opposite to that of the pressure roller 52 in the triboelectric series, the use of the difference between the polarity of the cut matter D and the polarity of the scraper 54 makes the cut matter D collected by the pressure roller 52 easily move to the scraper 54. Thus, the scraper 54 also collects the cut matter D, and the cut matter D collected by the pressure roller 52 is less likely to return to the medium M. Accordingly, the image formation apparatus can obtain a higher effect.

In this case, since the absolute value of the polarity value of the scraper 54 is greater than the absolute value of the polarity value of the pressure roller 52, the use of the difference between the polarity value of the pressure roller 52 and the polarity value of the scraper 54 makes the cut matter D more easily move from the pressure roller 52 to the scraper 54. This makes the cut matter D collected by the pressure roller 52 less likely to return to the medium M. Accordingly, the image formation apparatus can obtain a much higher effect.

Furthermore, since the cutter 44 includes the fixed blade 441 and the rotary blade 442, the use of the difference between the polarity of the medium M and the polarity of the fixed blade 441 makes it easier to positively charge the medium M, while the use of the difference between the polarity of the medium M and the polarity of the rotary blade 442 makes it easier to positively charge the medium M. Thus, the collection unit 50 collects the cut matter D more easily. Accordingly, the image formation apparatus can obtain a far higher effect.

Moreover, since the upstream guide 42 and the intermediate guide 45 each have the polarity opposite to that of the medium M in the triboelectric series, the use of the difference between the polarity of the medium M and the polarity of the upstream guide 42 makes it easier to positively charge the medium M, while the use of the difference between the polarity of the medium M and the polarity of the intermediate guide 45 makes it easier to positively charge the medium M. Thus, the collection unit 50 collects the cut matter D more easily. Accordingly, the image formation apparatus can obtain a far higher effect.

In this case, since the upstream guide 42 (the flat guide part 422) is provided with the inclined part 46, the use of the inclined part 46 makes the medium M easily come into contact with the upstream guide 42, and accordingly makes the medium M positively charged more easily. Thus, the collection unit 50 collects the cut matter D more easily. Accordingly, the image formation apparatus can obtain a far higher effect.

Besides, since the intermediate guide 45 includes the holder 451 and the guide plate 452; the guide plate 452 covers not only the holder 451 but also part of the fixed blade 441; and the holder 451 and the guide plate 452 have the polarity opposite to that of the medium M in the triboelectric series, the medium M is positively charged easily while smoothly conveyed. Accordingly, the image formation apparatus can obtain a far higher effect.

<2. Modifications>

The configuration of the image formation apparatus can be modified appropriately. Arbitrary two or more of the below-described modifications may be combined together.

[Modification 1]

Specifically, although the foregoing descriptions have been provided for the image formation apparatus with the medium M having the positive polarity, the medium M may have the negative polarity. This case can also obtain the same effects, if the cutter 44 and the pressure roller 52 each have the polarity (the positive polarity) opposite to the polarity (the negative polarity) of the medium M in the triboelectric series; and the resist roller 53 has a polarity value which is shifted from a polarity value of the pressure roller 52 toward an opposite polarity. In this case, if the polarity value of the resist roller 53 is less than the positive polarity value of the pressure roller 52, the polarity value of the resist roller 53 may be a negative polarity value or a positive polarity value.

[Modification 2]

Figure 15:
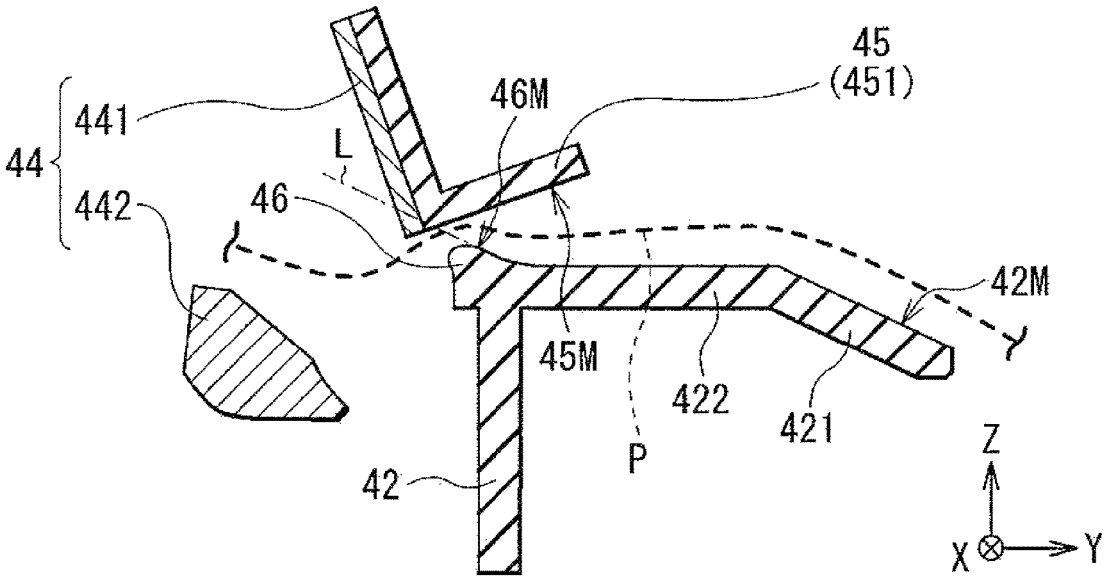
FIG. 15 is a diagram illustrating a cross-sectional view of a configuration of an image formation apparatus according to a modification.

In addition, although the above-discussed image formation apparatus uses the guide plate 452, the image formation apparatus according to the disclosure, for example, does not have to use the guide plate 452, as illustrated in FIG. 15 corresponding to FIG. 5. In the case where the image formation apparatus uses no guide plate 452, for example, the space 45S does not have to be provided there since the holder 451 is put in close contact with the entirety of the fixed blade 441.

This case can also obtain the same effects, since if the holder 451 has a polarity opposite to that of the medium M, the contact of the medium M into the contact surface 45M in the holder 451 makes the medium M positively charged easily. Furthermore, the absence of the space 45S makes the conveyance of the medium M less likely to be hindered even in the case where the holder 451 holds the fixed blade 441.

For the purpose of making the conveyance of the medium M smooth, however, it is preferable that the guide plate 452 be used, as illustrated in FIG. 5. This is because in the case where the holder 451 holds the fixed blade 441, there is likelihood that the medium M gets caught by a step formed in the boundary between the holder 451 and the fixed blade 441 even though the space 45S does not exist. In contrast to this, the use of the guide plate 452 makes it easy to convey the medium M smoothly, regardless of whether the space 45S exists, and regardless of whether the step exists.

[Modification 3]

Figure 16:
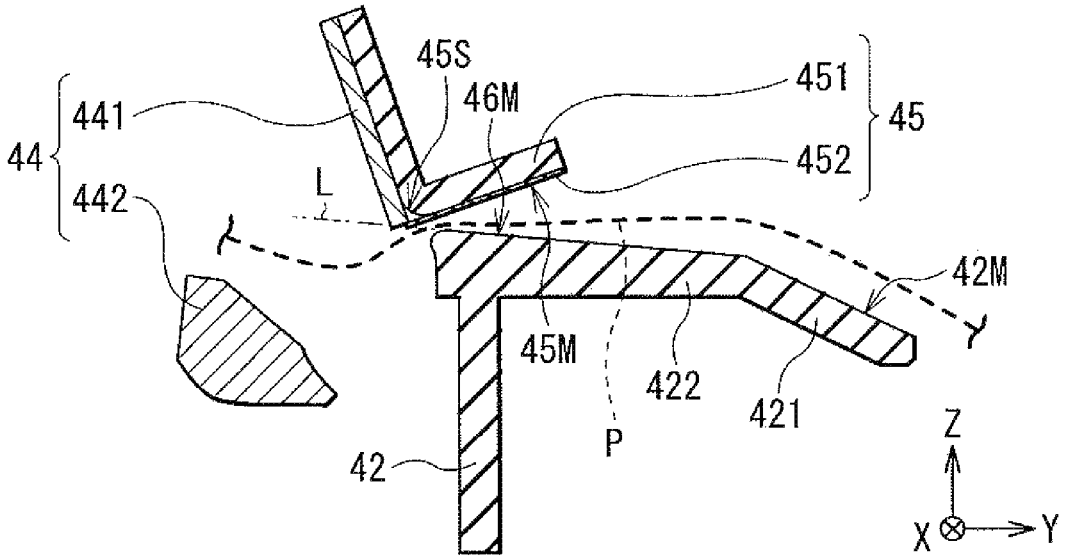
FIG. 16 is a diagram illustrating a cross-sectional view of a configuration of an image formation apparatus according to another modification.

Besides, although in the above-discussed configuration(s), the upstream guide 42 (the flat guide part 422) is provided with the inclined part 46, the upstream guide 42 may be configured, for example, such that the flat guide part 422 is provided with no inclined part 46 and the entirety of the flat guide part 422 is inclined, as illustrated in FIG. 16 corresponding to FIG. 5. In other words, the entirety of the support surface 42M of the flat guide part 422 may be inclined in a way that makes the downstream side of the flat guide part 422 in the conveyance direction H higher than the upstream side of the flat guide part 422 in the conveyance direction H. Even this case can obtain the same effects, since the medium M is guided in a way that makes the medium M come closer to the intermediate guide 45 (the guide plate 452).

[Modification 4]

Figure 17:
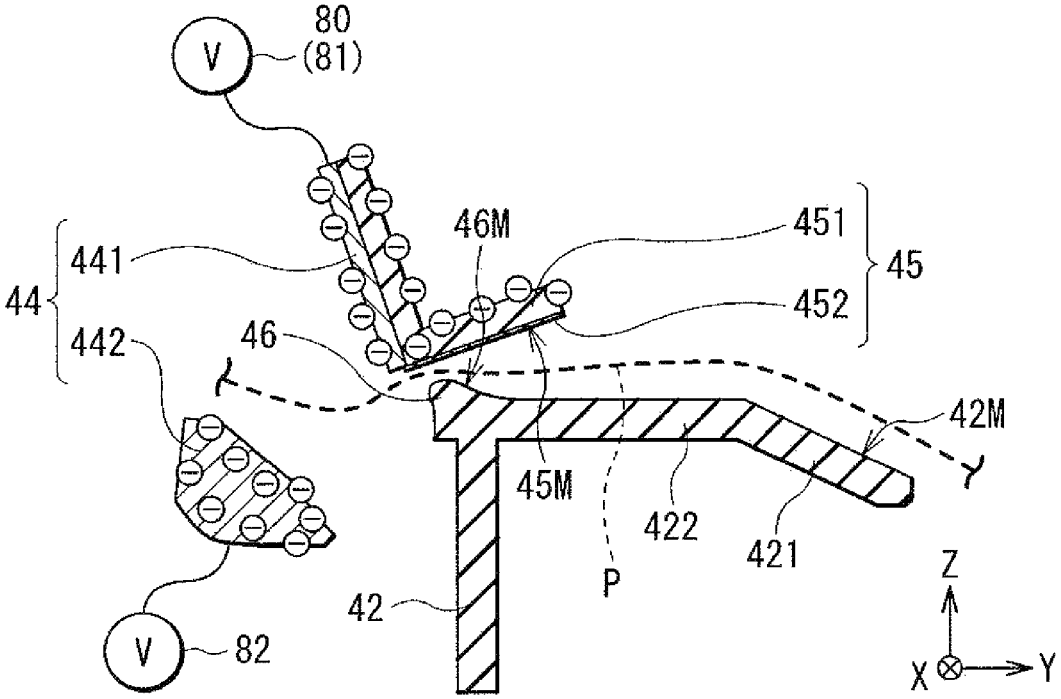
FIG. 17 is a diagram illustrating a cross-sectional view of a configuration of an image formation apparatus according to yet another modification.

Furthermore, the image formation apparatus may further include, for example, a power supply 80, as illustrated in FIG. 17 corresponding to FIGS. 5 and 8 to 10. In this modification, the power supply 80 may be referred to as a "power supply" according to an aspect of the one or more embodiments of the disclosure.

The power supply 80 is connected, for example, to the cutting unit 40 (the cutter 44), and applies to the cutter 44 a voltage (a direct-current voltage) which has the polarity opposite to that of the medium M in the triboelectric series. Specifically, the power supply 80 includes, for example, a fixed blade power supply 81 and a rotary blade power supply 82. The fixed blade power supply 81 is connected, for example, to the fixed blade 441, and applies the voltage to the fixed blade 441. The rotary blade power supply 82 is connected, for example, to the rotary blade 442, and applies the voltage to the rotary blade 442.

In this image formation apparatus, for example, in the case where the medium M has the positive polarity, when the cutting unit 40 cuts the medium M, the fixed blade power supply 81 applies the negative voltage to the fixed blade 441, and the rotary blade power supply 82 supplies the negative voltage to the rotary blade 442. This increases amounts of charge, respectively, on the fixed blade 441 and the rotary blade 442 having the negative polarity, and accordingly increases an amount of charge on the medium M having the positive polarity as well.

In this case, the use of the difference between the polarity of the medium M and the polarity of the fixed blade 441 makes it easy to positively charge the medium M, while the use of the difference between the polarity of the medium M and the polarity of the rotary blade 442 makes it easy to positively charge the medium M. Furthermore, the application of the negative voltage to the fixed blade 441 by the fixed blade power supply 81 makes it easy to further negatively charge the holder 451, and the use of the difference between the polarity of the medium M and the polarity of the holder 451 makes it easy to further positively charge the medium M.

Thus, the amount of charge on the medium M having the positive polarity increases greatly, which makes it extremely easy for the collection unit 50 to collect the cut matter D. Accordingly, the image formation apparatus can obtain a far higher effect.

Although the disclosure has been described using the above described embodiments, the invention is not limited to the above described embodiments. Accordingly, the embodiments may be modified variously.

For example, when the image formation apparatus performs the process of cutting the medium, the image formation apparatus may use folded strip-shaped media instead of a roll of media. In the case where the media are paper, the folded strip-shaped media are so-called fan-folded paper.

For example, the image formation apparatus is not limited to a full-color printer, and may be a monochrome printer. Moreover, the image formation apparatus is not limited to a printer, and may be a copying machine, a facsimile machine, a multifunctional printer, or the like.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

a cutting unit including a cutter configured to cut a medium, a polarity of the cutter being opposite to a polarity of the medium in a triboelectric series;

an image formation unit that includes a photosensitive drum and forms an image on the medium cut by the cutting unit; and a pressure contact unit arranged between the cutting unit and the image formation unit, and including a first pressure contact member and a second pressure contact member that are in pressure contact with each other across the medium cut by the cutting unit, and a plate-shaped member in pressure contact with the first pressure contact member to remove a matter attached on the first pressure contact member, a polarity of the first pressure contact member being opposite to the polarity of the medium in the triboelectric series, a polarity value of the second pressure contact member shifted from a polarity value of the first pressure contact member toward the polarity of the medium in the triboelectric series, and a polarity of the plate-shaped member being opposite to the polarity of the medium in the triboelectric series, wherein an absolute value of a polarity value of the plate-shaped member is greater than an absolute value of the polarity value of the first pressure contact member.

2. The image formation apparatus according to claim 1, wherein the first pressure contact member is rotatable.

3. The image formation apparatus according to claim 1, wherein the cutter of the cutting unit includes:

a first blade that is fixed; and a second blade that is rotatable while being in contact with the first blade.

4. The image formation apparatus according to claim 3, wherein the cutting unit further includes:

a first guide member configured to guide the medium toward the first blade and the second blade, a polarity of the first guide member being opposite to the polarity of the medium in the triboelectric series; and a second guide member that is arranged on a downstream side in a direction in which the medium is guided by the first guide member and is configured to guide the medium, guided by the first guide member, toward the first blade and the second blade, a polarity of the second guide member being opposite to the polarity of the medium in the triboelectric series.

5. The image formation apparatus according to claim 4, wherein the first guide member includes an inclined part inclined such that a portion of the inclined part closer to the second guide member becomes higher than a portion of the inclined part farther from the second guide member.

6. The image formation apparatus according to claim 4, wherein the second guide member includes a holder that holds the first blade, and a covering member that is provided on a surface of the holder facing the first guide member and extends to the first blade to cover a boundary between the first blade and the holder, a polarity of the covering member being opposite to the polarity of the medium in the triboelectric series.

7. The image formation apparatus according to claim 1, further comprising a power supply that applies a voltage to the cutter, a polarity of the voltage being opposite to the polarity of the medium in the triboelectric series.

8. The image formation apparatus according to claim 1, wherein the medium includes a first surface and a second surface opposite to the first surface, the image formation unit forms the image on the first surface of the medium cut by the cutting unit, and an outer circumferential surface of the first pressure contact member is in pressure contact with the first surface of the medium while being rotated, the plate-shaped member is opposed to the outer circumferential surface of the first pressure contact member to remove a matter attached on the outer circumferential surface of the first pressure contact member.

9. An image formation apparatus comprising:

a cutting unit including a cutter configured to cut a medium, a polarity of the cutter being one of positive and negative polarities in a triboelectric series;

an image formation unit that includes a photosensitive drum and provided downstream of the cutting unit and configured to form an image on the medium cut by the cutting unit; and a pressure contact unit arranged between the cutting unit and the image formation unit, and including a first pressure contact member and a second pressure contact member that are in pressure contact with each other across the medium cut by the cutting unit, and a plate-shaped member in pressure contact with the first pressure contact member to remove a matter attached on the first pressure contact member, a polarity of the first pressure contact member being the one of positive and negative polarities in the triboelectric series, a polarity value of the second pressure contact member shifted from a polarity value of the first pressure contact member toward the other of positive and negative polarities in the triboelectric series, and a polarity of the plate-shaped member being opposite to a polarity of the medium in the triboelectric series, wherein an absolute value of a polarity value of the plate-shaped member is greater than an absolute value of the polarity value of the first pressure contact member.

10. An image formation apparatus comprising:

a cutting unit including a cutter configured to cut a medium, a polarity of the cutter being opposite to a polarity of the medium in a triboelectric series;

an image formation unit that includes a photosensitive drum and forms an image on the medium cut by the cutting unit; and a pressure contact unit arranged between the cutting unit and the image formation unit, and including a first pressure contact member and a second pressure contact member that are in pressure contact with each other across the medium cut by the cutting unit, a polarity of the first pressure contact member being opposite to the polarity of the medium in the triboelectric series, a polarity value of the second pressure contact member shifted from a polarity value of the first pressure contact member toward the polarity of the medium in the triboelectric series, wherein the cutter of the cutting unit includes:

a first blade that is fixed; and a second blade that is rotatable while being in contact with the first blade, the cutting unit further includes:

a first guide member configured to guide the medium toward the first blade and the second blade, a polarity of the first guide member being opposite to the polarity of the medium in the triboelectric series; and a second guide member that is arranged on a downstream side in a direction in which the medium is guided by the first guide member and is configured to guide the medium, guided by the first guide member, toward the first blade and the second blade, a polarity of the second guide member being opposite to the polarity of the medium in the triboelectric series, and the first guide member includes an inclined part inclined such that a portion of the inclined part closer to the second guide member becomes higher than a portion of the inclined part farther from the second guide member.

11. An image formation apparatus comprising:

a cutting unit including a cutter configured to cut a medium, a polarity of the cutter being opposite to a polarity of the medium in a triboelectric series;

an image formation unit that includes a photosensitive drum and forms an image on the medium cut by the cutting unit; and a pressure contact unit arranged between the cutting unit and the image formation unit, and including a first pressure contact member and a second pressure contact member that are in pressure contact with each other across the medium cut by the cutting unit, a polarity of the first pressure contact member being opposite to the polarity of the medium in the triboelectric series, a polarity value of the second pressure contact member shifted from a polarity value of the first pressure contact member toward the polarity of the medium in the triboelectric series, wherein the cutter of the cutting unit includes:

a first blade that is fixed; and a second blade that is rotatable while being in contact with the first blade, the cutting unit further includes:

a first guide member configured to guide the medium toward the first blade and the second blade, a polarity of the first guide member being opposite to the polarity of the medium in the triboelectric series; and a second guide member that is arranged on a downstream side in a direction in which the medium is guided by the first guide member and is configured to guide the medium, guided by the first guide member, toward the first blade and the second blade, a polarity of the second guide member being opposite to the polarity of the medium in the triboelectric series, and the second guide member includes:

a holder that holds the first blade, and a covering member that is provided on a surface of the holder facing the first guide member and extends to the first blade to cover a boundary between the first blade and the holder, a polarity of the covering member being opposite to the polarity of the medium in the triboelectric series.

12. An image formation apparatus comprising:

a cutting unit including a cutter configured to cut a medium, a polarity of the cutter being opposite to a polarity of the medium in a triboelectric series;

an image formation unit that includes a photosensitive drum and forms an image on the medium cut by the cutting unit;

a pressure contact unit arranged between the cutting unit and the image formation unit, and including a first pressure contact member and a second pressure contact member that are in pressure contact with each other across the medium cut by the cutting unit, a polarity of the first pressure contact member being opposite to the polarity of the medium in the triboelectric series, a polarity value of the second pressure contact member shifted from a polarity value of the first pressure contact member toward the polarity of the medium in the triboelectric series; and a power supply that applies a voltage to the cutter, a polarity of the voltage being opposite to the polarity of the medium in the triboelectric series.

* * * * *